United States Patent [19]

Thomsen

[11] Patent Number: 4,561,420

[45] Date of Patent: Dec. 31, 1985

[54] WOODBURNING STOVE, FIREPLACE OR THE LIKE

[75] Inventor: Torben H. Thomsen, Brabrand, Denmark

[73] Assignee: Dalso Maskinfabrik AF 1976 A/S, Brabrand, Denmark

[21] Appl. No.: 320,960

[22] PCT Filed: Mar. 9, 1981

[86] PCT No.: PCT/DK81/00026

§ 371 Date: Nov. 4, 1981

§ 102(e) Date: Nov. 4, 1981

[87] PCT Pub. No.: WO81/02621

PCT Pub. Date: Sep. 17, 1981

[30] Foreign Application Priority Data

Mar. 7, 1980 [DK] Denmark ..... 979/80
Dec. 3, 1980 [DK] Denmark ..... 5145/80

[51] Int. Cl.[4] ..... F24C 1/14

[52] U.S. Cl. ..... 126/77; 126/67; 126/83; 126/152 B; 126/163 A; 431/347

[58] Field of Search ..... 126/2, 3, 61, 63, 66, 126/67, 72, 77, 83, 147, 160, 152 R, 152 A, 152 B, 163 R, 163 A, 75, 4, 73, 6, 273.5

[56] References Cited

U.S. PATENT DOCUMENTS

| | | | |
|---|---|---|---|
| Re. 7,427 | 12/1876 | Martin | 126/152 R |
| 99,092 | 1/1870 | Keyser | 126/83 |
| 559,867 | 5/1896 | Salomon | 126/64 |
| 586,886 | 7/1897 | Weiss | 126/160 |
| 702,984 | 6/1902 | Moon | 126/72 |
| 1,221,146 | 4/1917 | Columbro | 126/2 |
| 2,394,828 | 2/1946 | Westlake et al. | 126/77 X |
| 2,564,713 | 8/1951 | Miles | 126/73 |
| 2,703,567 | 3/1955 | Manchester et al. | 126/83 X |
| 4,091,748 | 5/1978 | Mansfield | 110/234 X |
| 4,111,181 | 9/1978 | Canney | 126/77 |
| 4,239,029 | 12/1980 | Martin et al. | 126/152 R X |
| 4,254,715 | 3/1981 | LaHaye et al. | 126/163 R X |
| 4,261,327 | 4/1981 | Kamin | 126/152 R X |

FOREIGN PATENT DOCUMENTS

| | | | |
|---|---|---|---|
| 538197 | 3/1977 | U.S.S.R. | 126/3 |

*Primary Examiner*—Samuel Scott
*Assistant Examiner*—Allen J. Flanigan
*Attorney, Agent, or Firm*—Antonelli, Terry & Wands

[57] ABSTRACT

A woodburning stove, fireplace, or the like which includes a hearth in a chamber with a flue outlet at a top thereof and a closeable bottom plate provided in a bottom of the chamber. A further chamber is provided under the plate, with the further chamber being lined with a refractory material. The further chamber includes a flue outlet duct to the upper chamber communicating at a rear end thereof so that flue from the fuel fired in the further chamber is substantially entirely combusted, with the combustion temperature being high and the combustion time for a given fuel supply in the further chamber being considerably longer as compared to the same amount of fuel in, for example, a conventional heating stove.

12 Claims, 16 Drawing Figures

WOODBURNING STOVE, FIREPLACE OR THE LIKE

Figure 1:
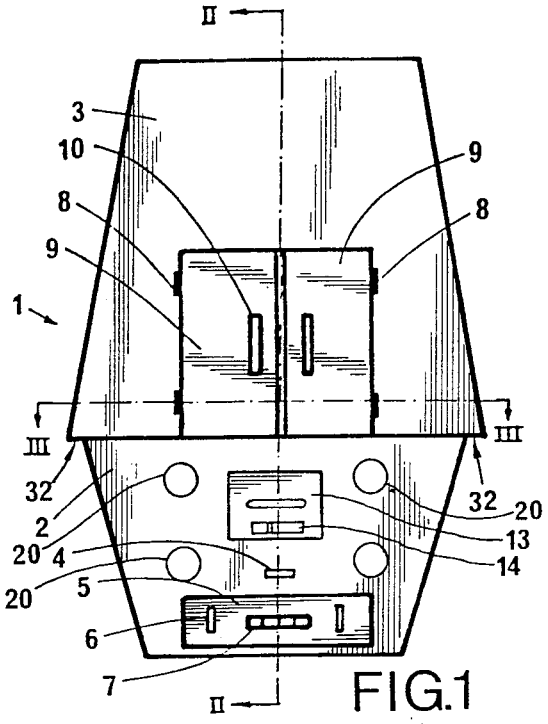

The present invention relates to a woodburning stove, a fireplace or the like comprising a hearth in a combustion chamber with a flue outlet at the top, said hearth being provided with a front opening or door.

Such fireplace in the form of a stove with two chambers is disclosed in U.S. Pat. No. 1,771,303 in which stove the separation between the chambers is formed by a grate in an always open position.

In accordance with advantageous features of the woodburning stove, fireplace or the like according to the invention a hearth is provided in a chamber with a flue outlet at a top thereof, with the hearth being provided with a front opening or front door. At least a part of a bottom of the hearth or chamber includes a preferably closable bottom plate. A further chamber for solid, liquid, or gaseous fuel is provided below the bottom plate with the chamber being underblast supplied, preferably, through an inlet air damper. A shaking grate is disposed above an ashpit, with the further or lower chamber being lined with a refractory material such as firebricks. A flue outlet from the lower chamber to the upper chamber is provided and is disposed preferably, at a rear end of the plate. By virtue of these features it was noticed that a substantially total combustion of the flue gas from the fuel suppled to the lower chamber was obtained therein. Simultaneously, the flue temperature became lower than that of a flue gas passing the grate as was the case in the stove according to the above noted U.S. patent. Furthermore, the combustion temperature is high and the burning time long for a given fuel supply compared to the same amount of fuel and the combustion in, for example, a conventional heating stove.

Furthermore, the bottom plate may serve as firing cap for the lower chamber as well as heat accumulating and heat reflecting device for the lower chamber.

In accordance with further features of the present invention, the bottom plate has a thickness of a plate of at least 5 mm and comprises one at least substantially air impermeable cover plate of iron and/or ceramic material. The flue duct or flue outlet from the lower chamber extends around the bottom plate to the upper chamber whereby it is possible to provide a particularly simple embodiment of the bottom plate in the fireplace or woodburning stove.

By providing a bottom plate which includes a preferably exchangeable subplate arranged below the cover plate at a distance therefrom of 0.1–15 mm and, preferably, 2 mm, which plate is provided with openings, whereby the glow temperature of the bottom plate gets higher than would be the case if the bottom plate comprises one single plate only. Consequently the combustion of the flue gas from the fuel in the lower chamber is more complete and thereby a larger emission of heat is supplied to the walls of the lower chamber, and the temperature of the bottom plate surface against the upper chamber is lower, which means a longer life of the upper plate than the bottom plate. Preferably, the lower plate is interchangeably mounted on the cover plate of the bottom plate as to reduce the maintenance costs.

To increase the above mentioned effects, in accordance with the present invention, the inner space between the two plates is filled with a refractory material such as asbestos or a similar high temperature resistant material. Additionally by preforming the bottom plate as a whole, the weight of which can be reduced as the upper cover plate is made thinner than in case of an air interspace between the cover plates and subplate.

Advantageously, the bottom face of the bottom plate has a larger surface area than the top face thereof so that the bottom plate surface facing the lower chamber is provided with a larger glow surface and contact surface with the flue gas in the lower chamber without an increase of the top side temperature of the bottom plate.

According to further features of the present invention, the bottom face of the bottom plate is provided with cam or rib-shaped projections whereby the underside surface is increased in relation to that of the top side. Presumably, this causes a slower movement of the flue gas in the interface facing the underside between the cams or the ribs, and thereby a lower underside temperature between these cams and ribs as well as a higher glow temperature in the outermost ends thereof.

According to the present invention, the bottom plate is a bottom grate for the upper chamber, with the bottom grate being adapted to be closed by a mutual displacement of an upper part and a lower part. The bottom plate is advantageously fashioned of a strong and solid material such as, for example, cast iron, with downward turned sides thereof presenting a pattern of elevations formed by grate bars, ribs, or cams whereby a considerable capacity for heat accumulation of the bottom plate is achieved, which accumulation, in combination with the heat shield function of the bottom plate, provides the lower chamber with an increased efficiency as regards the heat utilization. This increased efficiency is due in part to the heat distributed over the ceiling of the chamber, and in part to the uniform emission of radiation heat from the bottom plate mainly to the fuel and the walls of the lower chamber. Thereby the combustion temperature gets higher in the chamber than would be possible with a bottom plate of a thin material. The higher temperature in the chamber provides a greater guarantee for complete combustion. Of course, the heated flue gas rises to the upper chamber emitting heat to the walls thereof while the bottom plate also emits heat to the upper chamber, partly by convection and partly by radiation, said radiation also being emitted into the room in which the woodburning stove or the fireplace is placed, in case the opening of the stove is free or the door thereof is open. Furthermore, because of its high capacity for heat accumulation the bottom plate provides a uniform and constant heat emission to the fuel to be burned. Moreover, as the bottom plate can be closed, it may cause an increased heat emission to the chamber above the bottom plate if said plate is in its open position, with the bottom plate being adapted to be opened by a parallel displacement of the parts thereof.

According to the present invention, the bottom plate is mounted so as to be rotatable about at least one horizontal axis at the bottom of the upper chamber so that the bottom plate may serve as firing opening for the lower chamber as well as ash shutter for the upper chamber so that ashes from the upper chamber may fall into the lower chamber and possibly further down to the subjacent ash pan. The entire bottom plate, however, can be horizontally displaceably mounted, e.g. for the purpose of horizontal pull-out through the inlet opening of the upper furnace whereby the inlet opening of the lower chamber can be expanded, and in its pulled-out position the bottom plate may serve as a support plate for the fuel to be supplied to the lower chamber. When pulled out and tilted upward the bottom plate may serve as chute for transport of ashes and/or fuel from the upper chamber to the lower chamber.

In order to enable the bottom plate to serve as a hot-plate for cooking pots etc. to be placed on or in the bottom plate via the firing opening of the upper chamber, and/or to provide for an easily exchangeable bottom plate, and/or to enable the bottom plate to serve as firing cap and ash shutter, the bottom plate is constituted by, preferably, concentrically disposed ring-shaped plate elements, wherein each plate element of the concentrically disposed plate elements is preformed so as to support adjacent inner plate elements. Advantageously the number of rings correspond to the size of the fuel in question. Additionally by providing a plurality of interchangeable rings, the rings may be temporarily removed, when it is desired to remove ashes from the upper to the lower chamber.

In accordance with still further features of the present invention, the side walls of the lowermost chamber are lined with a refractory material with, preferably, heat convection tubes or channels passing through the refractory material wherein high yield temperature solid fuel may be used for firing, an increased capacity for heat accumulation of the lower chamber walls may be obtained and a quicker transmission of heat to places where it is needed takes place by means of the heat convection channels.

Figure 2:
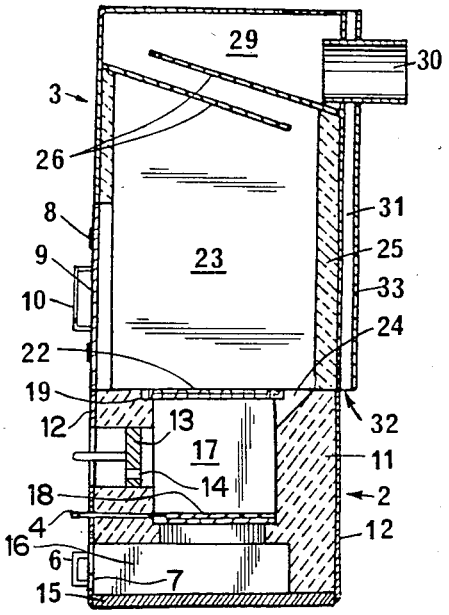
Figure 3:
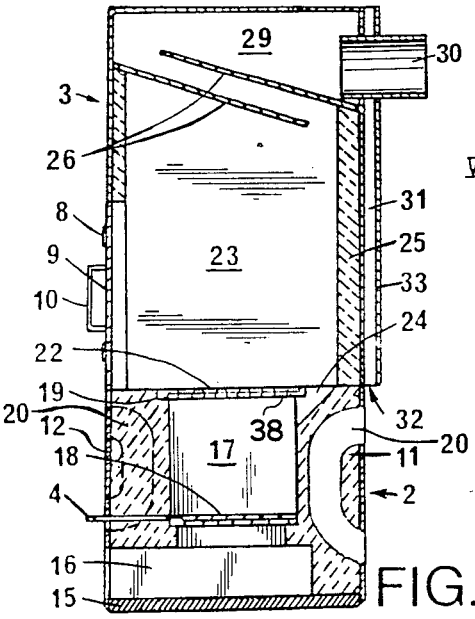
Figure 4:
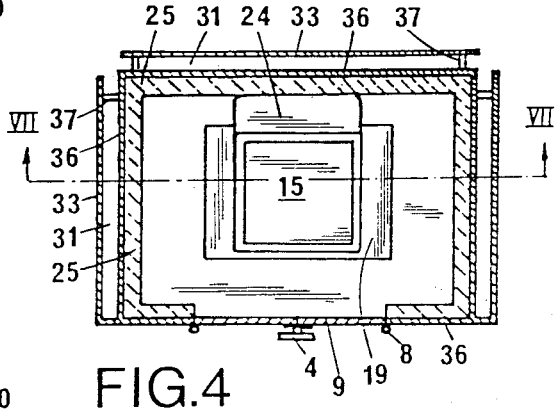
Figure 5:
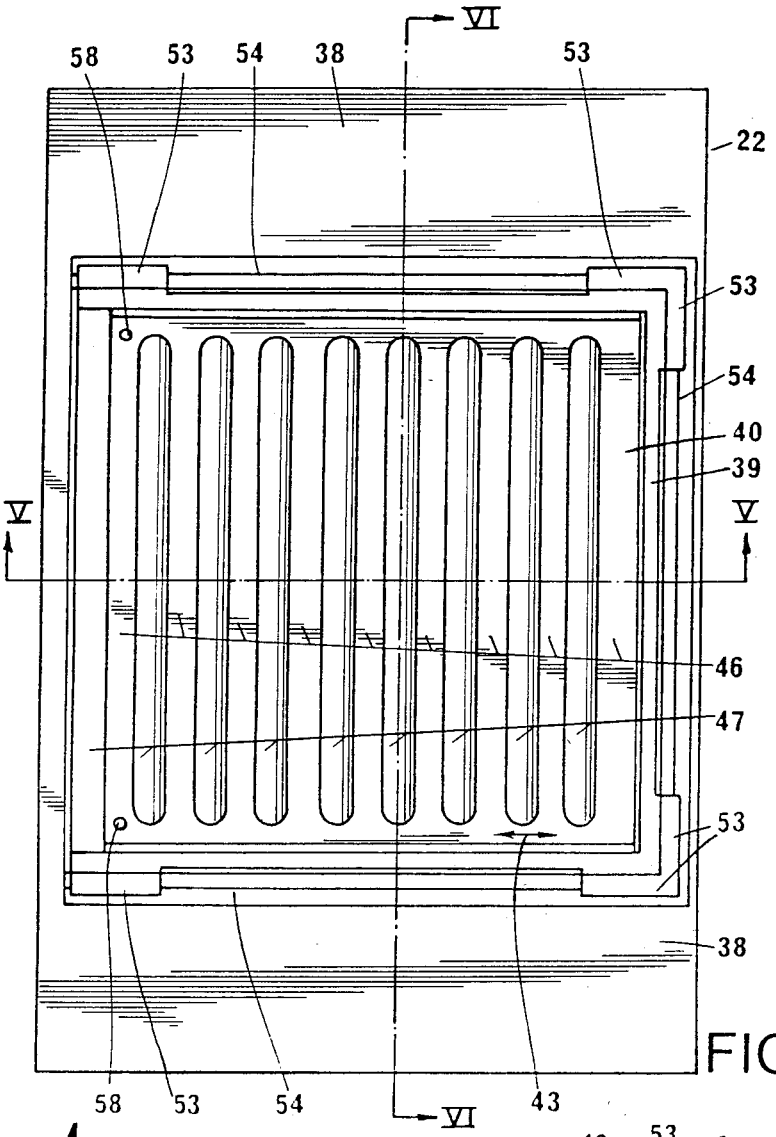
Figure 6:
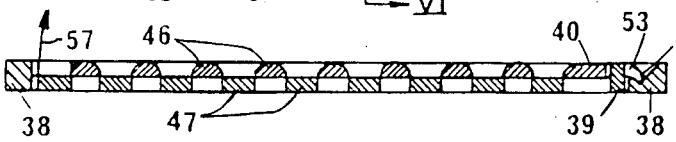
Figure 7:
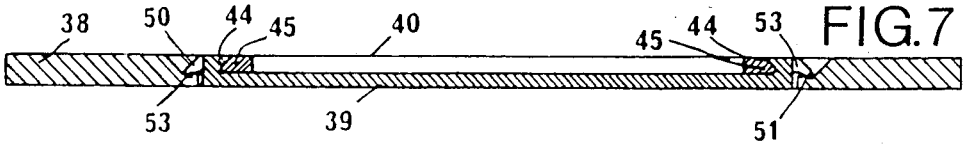
Figure 8:
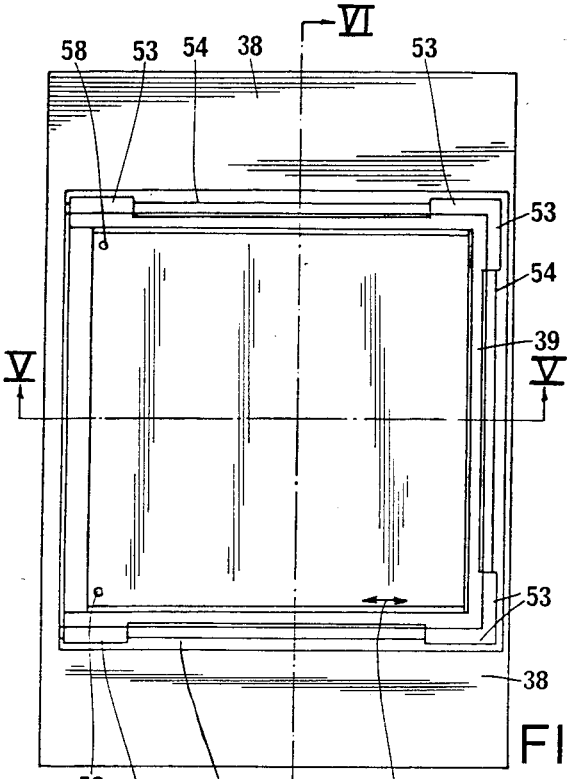
Figure 9:
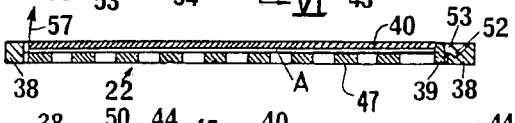
Figure 10:
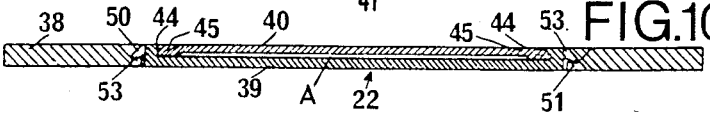
Figure 11:
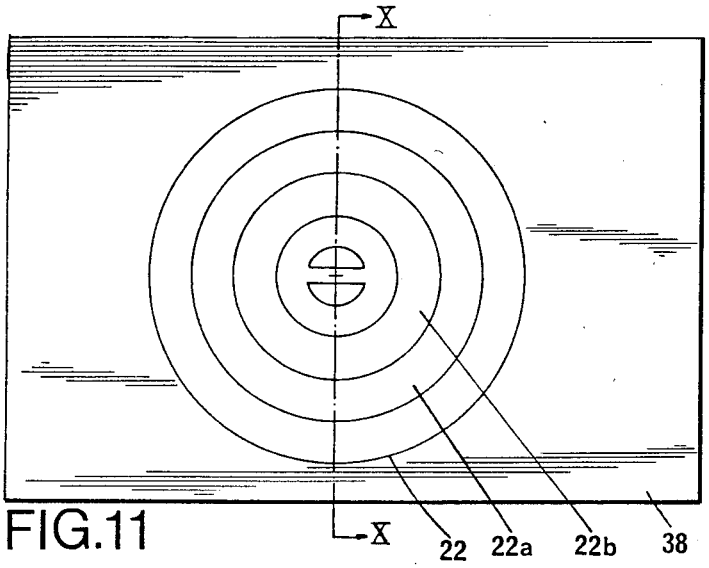
Figure 12:
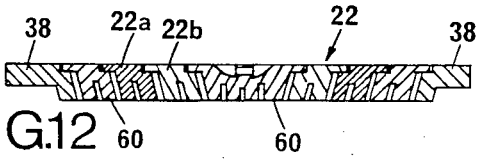
Figure 13:
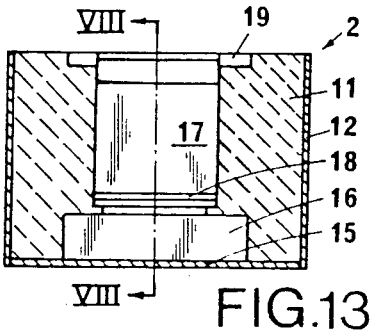
Figure 14:
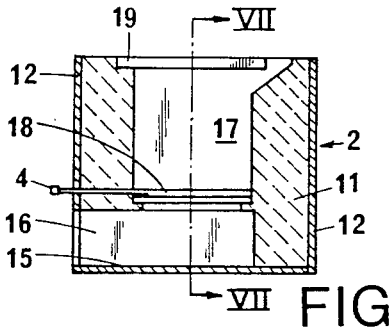
Figure 15:
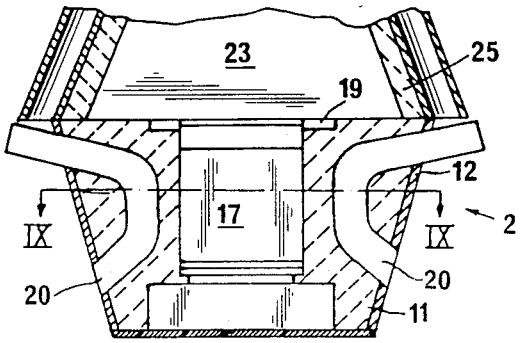
Figure 16:
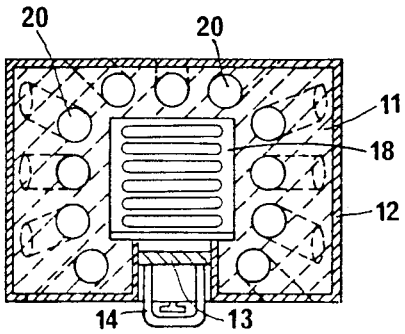

The invention will now be explained in more detail in connection with some embodiments and with reference to the drawings in which FIG. 1 is a front view of a woodburning stove according to the invention with closed front doors, FIG. 2 is a cross-sectional view taken along the line II—II in FIG. 1, in which the ash pit is shown without ash pan, FIG. 3 is a cross-sectional view taken along the line II—II in FIG. 1 in an embodiment with heat convection channels surrounding the lower chamber, FIG. 4 is a cross-sectional view taken along the line III—III in FIG. 1, wherein, for example, the bottom plate between the upper chamber and the lower chamber is removed, FIG. 5 is a top view, on an enlarged scale, of a bottom plate in the form of a bottom grate, FIG. 6 is a cross-sectional view taken along the line V—V in FIG. 4, FIG. 7 is a cross-sectional view taken along the line VI—VI in FIG. 5, FIG. 8 is a top view, on an enlarged scale of a bottom plate without a grate, FIG. 9 is a cross-sectional view taken along the line V—V in FIG. 8, FIG. 10 is a cross-sectional view taken along the line VI—VI in FIG. 8, FIG. 11 is a top view of a bottom plate formed by more plate elements, FIG. 12 is a cross-sectional view taken along the line X—X in FIG. 11, FIG. 13 is a cross-sectional view taken along the line VII—VII in FIG. 14 through an extension of existing fireplaces and woodburning stoves, said extension may also form a construction detail of a fireplace or woodburning stove according to the invention, FIG. 14 is a cross-sectional view taken along the line VIII—VIII in FIG. 13, FIG. 15 is a cross-sectional view taken along the line VII—VII in FIG. 4 through the lower chamber of the two chamber stove of FIG. 3, and FIG. 16 is a cross-sectional view taken along the line IX—IX in FIG. 15.

FIG. 1 shows a fireplace or woodburning stove 1 according to the invention comprising an extension or lower part 2 and an upper part 3. The lower part 2 is provided with a handle 6 and an inlet air control damper 7 for underblast. The upper part 3 is provided with hinges 8 whereby the doors 9 are pivotably mounted. The doors 9 are provided with handles 10. A detachable cleanout cap 13 with an inlet air damper and a handle blocks the cleanout opening of the lower chamber. As shown in FIG. 2 the lower part 2 is built of a fireproof material 11 with an outer facing 12 and an ashpit bottom 15, e.g. of steel or cast iron. An ashpit 16 is provided in the fireproof material 11, in which ashpit the ashpan 5 can be inserted through an opening in the outer facing 12. Moreover, a lower chamber 17 is provided in the fireproof material 11, at the lower end of the chamber 17 a shaking grate 18 is connected to the handle 4 and is supported by an abutment in the fireproof material 11. At the top of the chamber 17, a chamber bottom plate 22 is supported by a recess 19, with the bottom plate 22 forming part of the bottom of an upper chamber 23 arranged in the upper part 3. The chamber bottom plate 22 is, directly or by a support plate 38, (FIG. 4), supported in the upper chamber 23 of the fireproof material 11 in recess 19, and, moreover, a stationary flue duct 24 for passing flue gas from the chamber 17 to the chamber 23 is provided in the fireproof material 11 at the outer circumference of the chamber bottom plate 22. The chamber bottom plate may consist of one horizontal plate 39, 40 or of two such plates as shown in FIGS. 6, 7 or 9, 10. The upper chamber 23 is, at least in the lower part thereof, possibly also on the doors 9, lined with a fireproof material 25. At its top the chamber 23 is provided with guide plates 26 passing the flue gas from the chamber 23 at the rear wall thereof, in between said plates 26 and to an upper smoke box 29, then leaving the woodburning stove through a flue gas outlet pipe 30. The upper part 3 is, moreover, provided with a double casing for the circulation of the surrounding air via plate interspaces 31 wherein the air flows in at the bottom and out at the top as indicated by arrows 32 in FIGS. 1 and 2. The stove doors 9 per se may be provided with air circulation in a stove door double casing whereby the doors and the handles thereof will appear cool in use.

FIG. 4 shows a top view of the lower part 2 in section III—III in FIG. 1 in the absence of the shaking grate 18 as well as the support plate 38 and the chamber bottom plate 22, so that the ashpit bottom is visible, via the recess 19 and the lower chamber 17, from the upper chamber 23. The plates 33 forming the spaces 31 for the circulating rising circulation air together with the steel facing 36 are fixed by spacer bolts 37.

As shown in FIG. 5 a chamber bottom plate 22 in the form of a bottom grate 22, is supported by the support plate 38 and comprises two grate elements 39 and 40. The grate element 40 is longitudinally displaceable, in the direction of the arrow 44, and, consequently, displaceably supported by the grate element 39 in keyways 44 (FIG. 7) of the grate element 39. The longitudinal side edges 45 of the grate element 40 are connected to the keyways 44 via a dovetail joint. The grate 22 is closed in one extreme position of the grate element 40 as the grate bars 46 thereof cover the interspaces between the grate bars 47 of the grate element 39, and, in the other extreme position, the bottom grate 22 is open as the grate bars 46 are superposed by the grate bars 47 so that the interspaces of the grate bars 46, 47 are mutually in line. In the embodiment shown in FIGS. 5–7 the grate element 40 is provided with three possibilities of rotation around three axes of rotation 50–52, as peaky projections 53 each is supported by a groove 54 provided along three edges in the opening in the middle of the support plate 38. When the grate element 40 is swung around its axis of rotation 52 in direction of the arrow 57, the dovetail joint with the grate element 40 can be eliminated or established, and when the grate element 39 with inserted grate element 40 is swung to its uppermost position the end edge opposite the peaky projection 53 at the axis of rotation 52 can be supported by a support not shown, e.g. the rear wall of the upper chamber 22 so as to allow firing of fuel in the lower chamber 17. When convenient the grate elements 39, 40 can likewise be swung about their axes of rotation, 50 and 51, respectively, to the left or the right, respectively. The grate elements 39 and 40 are detachably supported by the grooves 54 of the support plate 38 but may also be stationarily hinged to the support plate 38 at one of the axes of rotation 50–52 or at an axis not shown, e.g. along VI—VI. The longitudinal displacement of the grate element 40 can be carried out by means of the holes 58 and a hook or the like. In the form and location set forth above, the grate 22 may serve as firing cap, heat accumulating device and reflector for the lower chamber 17, as air control damper and shaking grate for the upper chamber 23 besides as a grill plate and a hotplate. Of course, the grate elements 39, 40 as well as the support plate 38 need not be rectangular and may also be circular. As to the cross sectional shape of the lower chamber 17, such chamber 17, as with the grate elements 39, 40 and support plate 38 may also be of a circular cross-sectional shape.

FIGS. 8–10 show the same features as FIGS. 5–7 in which the grate elements are replaced by an upper, substantially air proof steel plate 40 and by a grate plate 39 arranged at a distance A of about 2 mm from the plate 40. One or both plates 39, 40 can be made of a fireproof material. Also in this case the chamber bottom plate 22, preformed and arranged as set forth above, may serve as firing cap, heat accumulating device and reflector for the lower chamber 17. The interspace A can be empty or filled with asbestos or a similar high temperature resistant material.

FIGS. 11 and 12 show an embodiment of the chamber bottom plate 22, said plate being divided into more ring-shaped plate elements 22*a*, 22*b*, the sectional shape of which comprises big downward projections 60.

FIGS. 13 and 14 show the lower part 2 as an extension of an already existing fireplace or woodburning stove which it is desired to expand for the purpose of firing with flue gas rich fuels such as coal, coke, or briquettes. The lower part 2 is then arranged below the fireplace in question and an opening corresponding to the upper surface of the entire lower part 2, is preformed, which opening then forms the new bottom of the fireplace, or corresponds to the total cross section of the lower chamber 17 and the stationary outlet pipe 24, and a groove, corresponding to the groove 19, is preformed in connection with the opening, so that the chamber bottom plate 22 can be arranged in the groove.

FIG. 15 shows the lower part 2 in which convection channels or tubes 20 are arranged in the side walls of the lower chamber 17. In excess of having air inlet to the lower chamber 17 via the ashpit 16, FIGS. 2, 3, 13 and 14, an opening with an inlet air damper 14 for secondary air may be preformed in the front side wall of the chamber 17, FIG. 1, the opening being of a size which allows cinders to be removed from the chamber 17. In that case, the opening is covered by the cleanout cap 13 having arranged therein the secondary air damper 14, with the opening being preferably covered by a displaceable vertical grate as is conventional in connection with stoves.

In FIGS. 1, 3, 15, and 16 U-shaped tubular convection air channels 20 are shown, with the channels 20 being arranged in a circle in the fireproof material around the lower chamber 17 for the removal of the heat from the fireproof material 11 and for increasing heat emission to the surroundings of the stove. However, the stove need not be provided with such air channels.

The air channels 20 may be totally or partly blocked by dampers not shown, e.g. for throttling down the passage of the convection air in case it is desired to maintain a low heat emission, low combustion speed and a throttled-down air inlet to the chamber 17, e.g. if the combustion is to take place after one single supply of fuel which is intended to last overnight.

What we claim is:

1. A woodburning stove, fireplace or the like comprising a hearth or a first chamber with a flue outlet at a top thereof, said hearth being provided with a front opening or a front door, characterized in that at least a part of the bottom of the hearth or first chamber includes a closeable heat resistant bottom plate, said heat resistant bottom plate being closed and substantially air impermeable during normal firing conditions, a further chamber for alternative combustion of solid, liquid or gaseous fuel and also flue gas rich fuel is provided immediately below the bottom plate forming the upper boundary of the combustion zone of said further chamber, said further chamber having a total height being substantially equal to lesser of the width and depth of said further chamber and an air inlet damper means and a shaking grate above an ash pit in the bottom of said further chamber for supplying air to said further chamber, the further chamber is lined with a refractory material such as bricks, and in that a permanently open flue outlet means is provided at the rear end of the bottom plate for constantly communicating the further chamber with the first chamber, the bottom plate being of a high heat resistant material and is placed at a level above the flames from the fuel so that the bottom side of said bottom plate glows during normal firing conditions so as to obtain a total combustion of flue gas from fuel supplied to the further chamber within said further chamber.

2. A stove according to claim 1, characterized in that the bottom plate has a thickness of at least 5 mm and comprises one at least substantially imperforate upper cover plate of an iron alloy, and in that the flue outlet means from the further chamber extends around a rear edge of the bottom plate to the first chamber.

3. A stove according to claim 2, characterized in that the bottom plate further comprises an exchangeable subplate arranged below the cover plate at a distance therefrom of 0.1–15 mm, preferably 2 mm, said subplate being provided with a plurality of openings.

4. A woodburning stove, fireplace or the like comprising a hearth or a first chamber with a flue outlet at a top thereof, said hearth being provided with a front opening or front door, characterized in that at least a part of the bottom of the hearth or first chamber includes a closeable heat resistant bottom plate, said heat resistant bottom plate being closed and substantially air impermeable during normal firing conditions, a further chamber for solid liquid or gaseous fuels is provided below the bottom plate, via an inlet air damper means and a shaking grate above an ash pit in the bottom of said further chamber for supplying air to said further chamber, the further chamber is lined with a refractory material such as fire bricks, a permanently open flue outlet means is provided at a rear end of the bottom plate for constantly communicating the further chamber with the first chamber so as to obtain a total combustion of flue gas from fuel supplied to the further chamber, the bottom plate has a thickness of at least 5 mm and comprises at least one substantially air impermeable cover plate of at least one of iron and ceramic material and is disposed at a level above the flames of the fuel so that a bottom side of said bottom plate glows during normal firing conditions, said flue outlet from the further chamber extends around the bottom plate of the first chamber, an exchangeable subplate is arranged below the cover plate at a distance therefrom of 0.1–15 mm, preferably 2 mm, said subplate being provided with a plurality of openings, and in that an interspace between the subplate and cover plate is filled with a high temperature resistant refractory material.

5. Stove according to claim 2, characterized in that the bottom face of the bottom plate, in its closed position has a larger surface area than the topface thereof.

6. Stove according to claim 1, characterized in that the bottom face of the bottom plate in its closed position is provided with one of a cam and rib-shaped projections.

7. Stove according to claim 1, characterized in that the bottom plate is a bottom grate for the first chamber, that said bottom grate can be closed by a mutual displacement of an upper part and a lower part, that the bottom plate is made of a strong and solid material, such as cast iron, and that the downward turned sides thereof present a pattern of elevations formed by one grate bars, ribs and cams.

8. Stove according to claims 7, characterized in that the bottom plate is rotatably mounted round a horizontal axis at the bottom of the first chamber.

9. Stove according to claim 5, characterized in that the bottom plate is constituted by ring-shaped plate elements, wherein each of the outermost plate elements is preformed so as to support one of the innermost elements.

10. A stove according to claim 1, wherein a bottom face of the bottom plate in the closed position thereof has a larger surface area than a top face thereof.

11. A stove according to claim 2, wherein a bottom face of the bottom plate in a closed position thereof exhibits at least one of a cam and rib-shaped projections.

12. A woodburning stove, fireplace or the like comprising a hearth or a first chamber with a flue outlet at the top thereof, said hearth being provided with a front opening or front door, characterized in that at least a part of the bottom of the hearth or first chamber includes a closeable heat resistant bottom plate, said heat resistant bottom plate being closed and substantially air impermeable during normal firing conditions, a further chamber for solid, liquid or gaseous fuel is provided below the bottom plate, an inlet air damper means and a shaking grate above an ash pit in the bottom of said further chamber for supplying air to said further chamber, the further chamber is lined with a refractory material such as firebricks, a flue outlet from the further chamber to the first chamber is provided at the rear end of the bottom plate, the bottom plate has a thickness of at least 5 mm and comprises at least one substantially imperforate cover plate of at least one of iron and ceramic material, sad flue outlet from the further chamber extends around the bottom plate to the first chamber, an exchangeable subplate is arranged below the cover plate at a distance therefrom of 0.1–15 mm, preferably 2 mm, sad subplate being provided with a plurality of openings, and in that an interspace between the subplate and cover plate is filled with a high temperature resistant refractory material.

* * * * *